US007455569B2

(12) United States Patent
Schäfer et al.

(10) Patent No.: US 7,455,569 B2
(45) Date of Patent: Nov. 25, 2008

(54) GRINDING AND POLISHING MACHINE FOR GRINDING AND/OR POLISHING WORKPIECES TO AN OPTICAL QUALITY

(75) Inventors: Holger Schäfer, Weilmünster (DE); Joachim Diehl, Giessen (DE); Lothar Urban, Solms (DE)

(73) Assignee: Satisloh AG, Baar (CH)

( * ) Notice: Subject to any disclaimer, the term of this patent is extended or adjusted under 35 U.S.C. 154(b) by 0 days.

(21) Appl. No.: 11/810,097

(22) Filed: Jun. 4, 2007

(65) Prior Publication Data

US 2007/0293128 A1 Dec. 20, 2007

(30) Foreign Application Priority Data

Jun. 16, 2006 (DE) ..... 10 2006 028 164

(51) Int. Cl.
*B24B 13/00* (2006.01)

(52) U.S. Cl. ..... 451/11; 451/42; 451/5

(58) Field of Classification Search ..... 451/42, 451/43, 5, 7, 11, 362, 65
See application file for complete search history.

(56) References Cited

U.S. PATENT DOCUMENTS 4,392,331 A 7/1983 Schimitzek et al.
5,618,222 A * 4/1997 Baima et al. ..... 451/14
6,155,911 A * 12/2000 Mandler ..... 451/42
6,383,061 B1 5/2002 Mandler
6,390,900 B1 * 5/2002 Susnjara ..... 451/178
6,394,892 B2 5/2002 Hanisch et al.

FOREIGN PATENT DOCUMENTS

DE 197 37 217 A1 3/1999
DE 197 51 750 A1 6/1999
WO WO 2005/105372 A1 11/2005

OTHER PUBLICATIONS

Bouchure—"Generating/Fining Toromatic Line", Loh Optikmaschinen AG, 8 pages.

* cited by examiner

*Primary Examiner*—Robert Rose
(74) *Attorney, Agent, or Firm*—Reising, Ethington, Barnes, Kisselle, P.C.

(57) ABSTRACT

A grinding and polishing machine, in particular for lenses, has at least one tool spindle and at least one workpiece. The tool spindle is constructed to hold a respective tool on the same axis at both ends and is mounted in a spindle housing which can be pivoted about a pivot axis arranged at right angles to the tool spindle in order to provide in each case one tool for machining engagement and also at various defined angle positions with respect to the workpiece spindle. A drive arranged on the pivot axis pivotably moves the tool spindle about the pivot axis for the desired machining engagement and rotates the tool about the pivot axis into the various angle positions with respect to the workpiece.

11 Claims, 11 Drawing Sheets

GRINDING AND POLISHING MACHINE FOR GRINDING AND/OR POLISHING WORKPIECES TO AN OPTICAL QUALITY

FIELD OF THE INVENTION

The invention relates to a grinding and polishing machine for grinding and/or polishing workpieces to an optical quality, in particular lenses. In addition to the machining of lenses, it should also be possible to machine complex optical components and shaped inserts using the machine.

BACKGROUND OF THE DISCLOSURE

In order to carry out complex machining operations, until now it has been necessary to use one or even several grinding and polishing machines having a plurality of accurately operating tools. Besides single-spindle machines, machines are also known which use a number of machining spindles and also tool changers which can be used to automatically change the machining tools.

In one such known machine (DE 100 29 967 A1) for machining optical workpieces, the workpiece spindles are arranged in a yoke while two tool spindles are arranged according to the so-called gantry concept in a portal structure above the yoke with three linear axes which can be displaced perpendicular to one another. In order to pivot the yoke, use is made here of a torque motor which makes it possible to achieve angle settings with high precision. However, the high engineering complexity required for this prevents cost-effective manufacture of this machine. Furthermore, the use of a tool changer requires mechanical interfaces between the tools and the tool spindles, and therefore the tool spindles require complex integrated clamping systems. However, with these interfaces, it is difficult to achieve the reproducibility required in highly precise grinding machining with regard to the concentricity and planarity of the tool in view of the desired accuracies of around one micrometer.

Combination tools are also known (DE 197 37 217 A1), in which two cup-grinding tools are arranged such that they can be displaced coaxially and axially with respect to one another in order to produce polishable lenses by means of coarse and fine grinding. However, the tool diameter here is limited and both the rigidity of the connection to the spindle and the concentricity of the grinding lips are capable of being improved. The axial displacement of the tools with respect to one another is also susceptible to problems due to the coolant becoming loaded with glass dust.

In a further known method using an associated device (DE 197 51 750 A1), three or more grinding spindles and optionally measurement stations are arranged parallel to one another and next to one another on a common carriage. The number of spindles, the complexity of the spindle control system, the initial outlay, the subsequent adjustments and the increased space requirement of the structure lead to considerable overall costs.

A known type of grinding and polishing machine has been developed by Loh Optikmaschinen AG, Wetzlar, under the name "Toromatic-2 SL". This machine, which operates according to a "swing spindle" concept, comprises a tool spindle with a respective cutting and grinding tool flanged to the ends of the spindle. In order to be able to bring the respective tool into engagement with the workpiece, the spindle can be pivoted like the head of a revolver about its pivot axis arranged at right angles to the spindle, and can be fixed in these locking positions assigned to the two tools. In order to adjust the angle of the tool spindle with respect to the workpiece spindle, on this machine an additional device is provided which consists of a pivoting head which can be rotated about a further axis and is provided with an additional hydraulic drive. Arranged on the pivoting head, at a distance from the axis of rotation thereof, is the pivot axis of the spindle housing which holds the tool spindle. This arrangement thus requires two different drives for the 180° pivoting of the tool spindle on the one hand and for the angle positioning of the tool spindle with respect to the workpiece spindle on the other hand.

What is needed is a compact and highly accurate grinding and polishing machine which makes it possible in a simple and cost-effective manner to use a plurality of grinding and polishing tools.

SUMMARY OF THE INVENTION

According to the present invention, there is provided a grinding and polishing machine for grinding and/or polishing workpieces to an optical quality, in particular lenses, said machine comprising at least one tool spindle with two ends and at least one workpiece spindle which can be adjusted relative to one another in directions perpendicular to one another, wherein the tool spindle is constructed to hold a respective tool on the same axis at both ends of the tool spindle and is mounted in a spindle housing which can be pivoted about a pivot axis arranged at right angles to the tool spindle in order to provide in each case one of the two tools for engagement with the workpiece, and can rotate the tool spindle into various defined angle positions with respect to the workpiece spindle. A drive is arranged on the pivot axis to drive the tool spindle to both pivot about the pivot axis for the desired tool engagement with the workpiece and rotate about the pivot axis into various defined angle positions with respect to the workpiece spindle.

According to the invention, the two axes present, namely the pivot axis which serves for the tool change and the axis of rotation which serves to set defined angle positions between the tool spindle and the workpiece spindle, are combined to form a single common pivot/rotation axis. The tool spindle with the tool respectively in use can be rotated into various angle positions both statically and dynamically. A drive system is used for both functions, namely the tool change pivoting movement and the rotational movements to change the angle positions between the tool spindle and the workpiece spindle.

Preferably, the drive system is a torque motor arranged on the same axis as the pivot axis, the rotor thereof being permanently connected to the spindle housing via a pivoting shaft. In this way, not only is a compact direct drive achieved for the spindle housing, but also highly precise angle positions are possible.

In the simplest embodiment, the grinding and polishing machine according to the invention can be equipped with just one tool spindle. However, it is also advantageous to provide a plurality of tool spindles, for example two tool spindles, parallel to one another in the spindle housing, as a result of which the versatility of the machine according to the invention is increased with regard to the different tools used on the workpiece spindles and accordingly the different workpiece geometries/materials that can be machined.

In any case, the arrangement is preferably such that the pivot axis runs (essentially) through the center of gravity of the spindle housing, regardless of the number of tool spindles. In this way, the spindle housing with the tool spindles mounted thereon can be pivoted and can be rotated into defined angle positions without having to overcome troublesome inertias caused by an eccentric center of gravity.

In a further embodiment of the invention, at least one functional element for detecting the workpiece geometry or for handling the workpiece may be attached laterally to the outside of the spindle housing. In this way, measurements of the workpiece geometry can be carried out in situ immediately before, during or after various machining stages and any necessary corrections can be taken into account automatically by the CNC control system. In order to detect the workpiece geometry, a measurement sensor may be attached as the functional element to the spindle housing, or a ring spherometer with the interposition of a flexible rubber layer for measuring radii on workpieces. Due to the pivotability of the spindle housing and thus of the measurement sensor or spherometer, it is possible to place these functional elements in the normal direction at any location on the workpiece, as a result of which incorrect measurements caused by oblique sensing can reliably be avoided.

Instead of a mechanical measurement sensor as the functional element for detecting the lens thickness and lens contour, it is also possible to use a contactless measurement system, for example a pneumatic system operating on a dynamic pressure basis (rebound nozzle). An optical measurement system may also be used as the functional element. Suitable optical measurement systems include, for example, laser autofocus, laser triangulation or interferometric systems.

A loading arm with a suction cup or gripper may be attached as the functional element to the spindle housing for workpiece handling purposes. It is also possible for several different functional elements to be attached laterally to the outside of the spindle housing at different points.

The available CNC axes, by means of which the spindle housing can be moved linearly and pivoted, are used during handling of the workpiece in such a way that workpieces are transported for example from a workpiece magazine into the holding chuck of the workpiece spindle and vice versa. The pivotability of the spindle housing can also be used to turn a workpiece over, which allows two-sided machining. It is thus also possible to carry out automated tool profile measurements or adjustments on measurement sensors or auxiliary adjustment elements which are fixed to the machine at any point in the field of action of the spindle housing, e.g. including overhead opposite the workpiece spindle. A number of measurement stations can be provided in the field of action of the spindle housing without significantly increasing the size of the machine.

The invention allows a particularly advantageous central supply of coolant directly into the interior of the tools used. To this end, it is provided that the tool spindle can be provided with a central tube essentially over its entire length, which central tube is connected through the tool at both ends to internal recesses of the tools for the purpose of supplying coolant, wherein a coolant nozzle is positioned on the side of the tool spindle remote from the active tool. To this end, a nozzle holder is attached to the spindle housing by means of a pneumatic or electrical rotary drive, which ensures that the nozzle can supply coolant through the inactive tool from above.

The concept according to the invention makes it possible in a cost-effective manner and with much lower technical complexity than in the prior art to bring more tools than in all the previous embodiments into engagement with the workpiece in a precise and accurate manner, in order thus to machine a large number of complex surfaces and components while largely avoiding special tools. The concept according to the invention makes it possible to carry out all the customary grinding and polishing processes, such as rotary transverse or rotary longitudinal edge grinding and polishing, external cylindrical grinding and polishing, cup grinding or face grinding and polishing. When polishing it is possible to use, in addition to tools for special lens geometries, also in particular standard polishing tools with different so-called polishing bases for pre-polishing and fine polishing.

BRIEF DESCRIPTION OF THE DRAWINGS

Further details regarding the invention will be explained in more detail below with reference to the partially schematic drawings which show examples of embodiments. In the drawings.

DETAILED DESCRIPTION OF THE PREFERRED EMBODIMENTS

Figure 1:
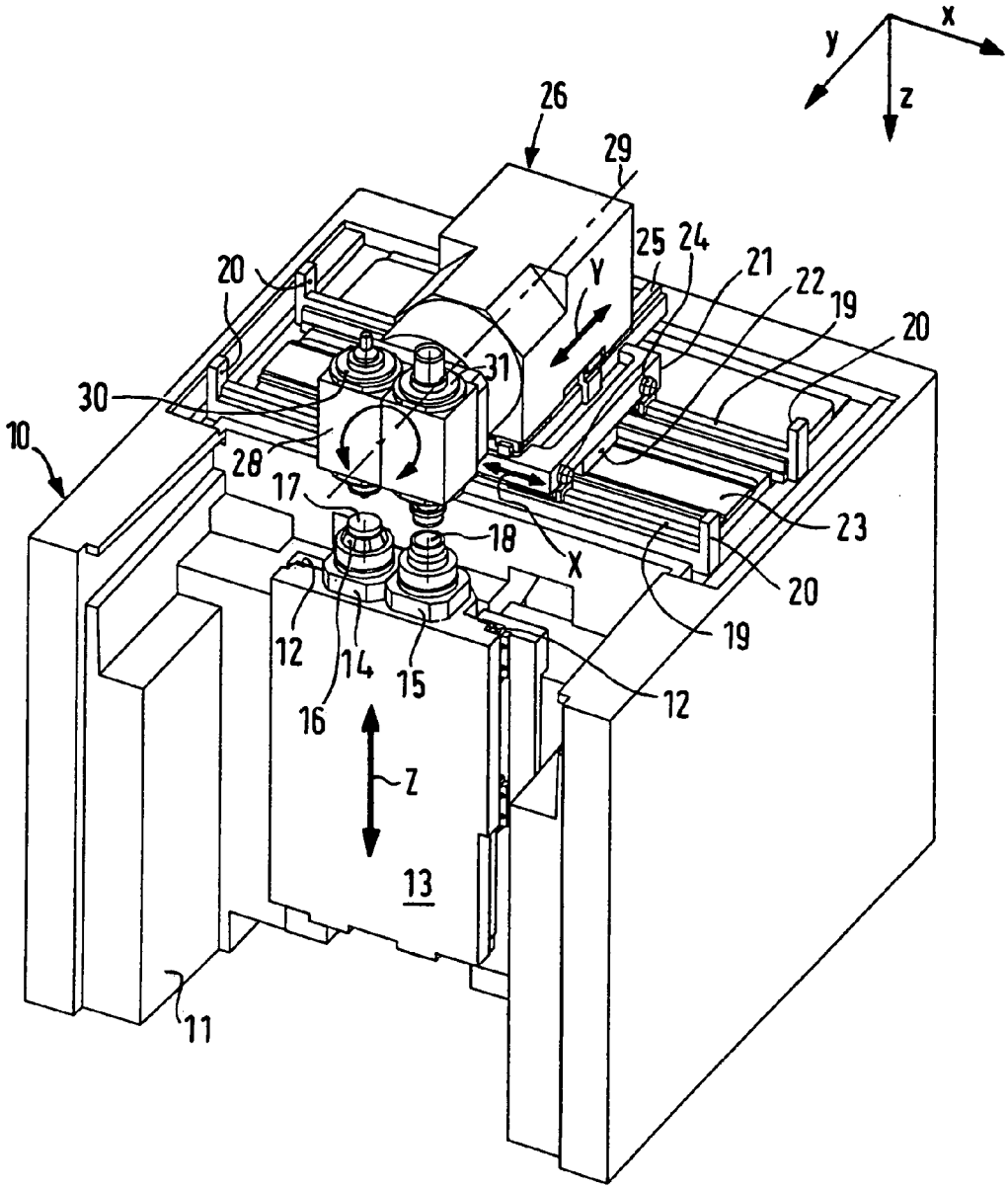
FIG. 1 shows the grinding and polishing machine according to the invention in a perspective view.

FIG. 1 shows a CNC-controlled grinding and polishing machine 10, in particular for machining optical lenses in a right-angled Cartesian co-ordinate system, in which the letter x denotes the width direction, the letter y denotes the length direction and the letter z denotes the height direction of the machine 10.

The machine 10 has a machine frame 11 which is formed from a monolithic block of polymer concrete. Fixed to the machine frame 11 at the front of the machine are two guide rails 12 which extend parallel to one another in the vertical height direction z. A Z-shuttle 13, which can be moved in a CNC-controlled manner in both directions of a Z-axis by means of associated CNC drive and control elements (not shown), is mounted on the guide rails 12 such that it can be displaced via guide carriages.

Provided on the Z-shuttle 13 are two workpiece spindles 14 and 15 which are arranged parallel to one another and the angle position of which with respect to their axes of rotation can be adjusted via CNC control. In the example shown, a collet chuck 16 is attached to the workpiece spindle 14 and clamps a lens 17 for machining. In the example shown, the other workpiece spindle 15 is equipped with a vacuum chuck 18 for securing the workpiece.

Fixed to the machine frame 11 on the top of the machine 10 are two guide rails 19 which extend parallel to one another in the horizontal width direction x. The two guide rails 19 are delimited by end stops 20. An X-shuttle 21, which can be moved in a CNC-controlled manner in both directions of an X-axis by means of a linear motor, is guided on the guide rails 19 such that it can be displaced via guide carriages. The primary part 22 of the linear motor is fixed to the X-shuttle 21, while the secondary part 23 is arranged between the guide rails 19 on the machine frame 11. Rubber buffers 24 which are assigned to the end stops 20 are attached to the X-shuttle 21.

Figure 3:
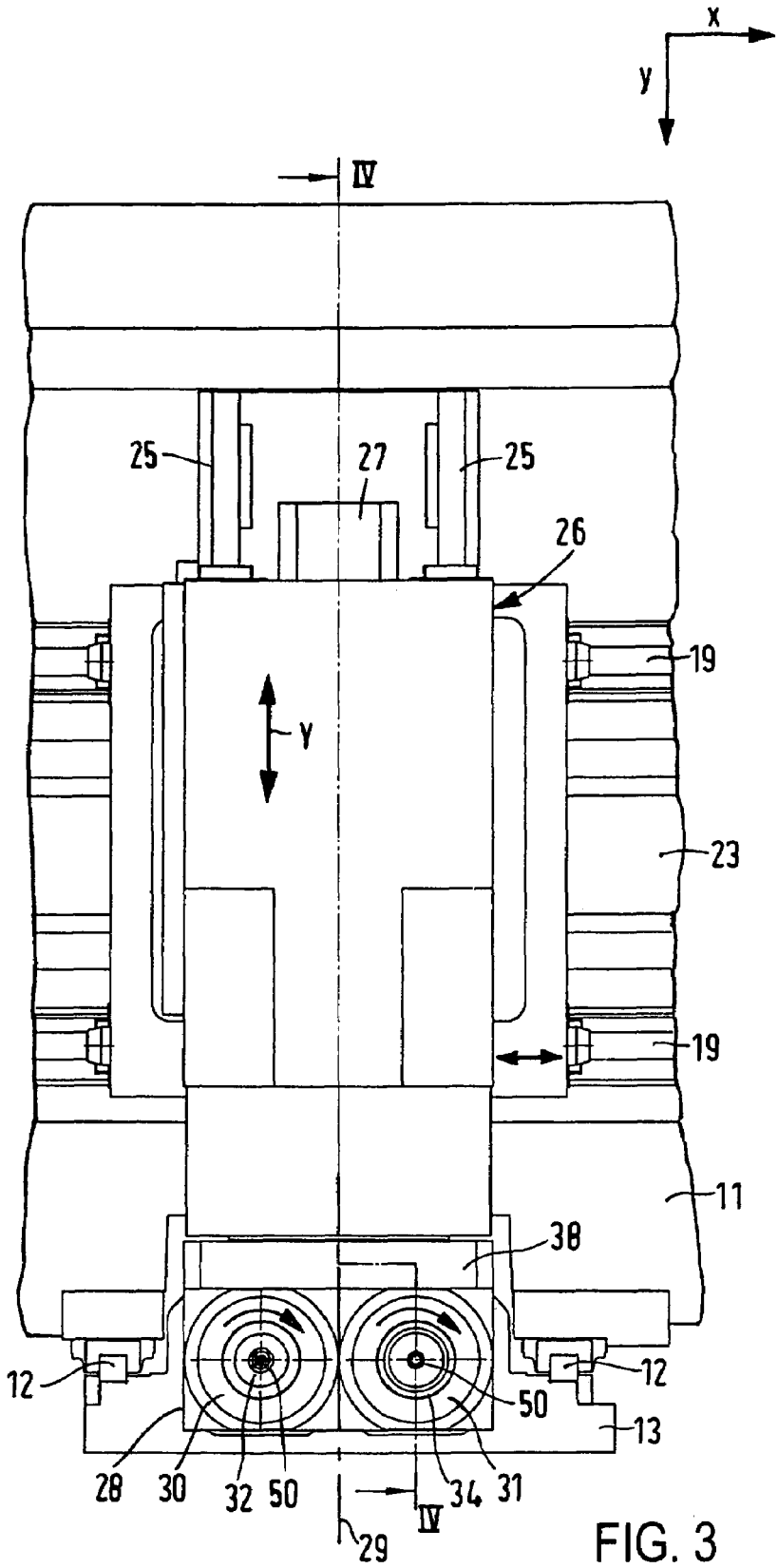
FIG. 3 shows the broken-away plan view of the machine.

Fixed to the X-shuttle 21 are two guide rails 25 which extend parallel to one another in the horizontal length direction y, as can be seen from FIG. 1 in conjunction with FIG. 3. A drive motor 26 is guided on the guide rails 25 such that it can be displaced via guide carriages, which drive motor can be moved in a CNC-controlled manner in both directions of a Y-axis by means of a further linear motor, of which only the secondary part 27 attached to the X-shuttle 21 between the rails 25 can be seen in FIG. 3. In a manner that will be described in more detail below, the drive motor 26 forms a pivoting device for a spindle housing 28 which is arranged above the workpiece spindles 14 and 15 and will also be described in more detail below. Reference 29 denotes a horizontal pivot axis for the spindle housing 28.

In the example of embodiment shown in FIGS. 1 to 4, two tool spindles 30 and 31 which are arranged parallel to one another are provided in the spindle housing 28, which tool spindles can be driven in rotation at a controlled speed by e.g. a respective torque motor. The two tool spindles 30, 31 are designed to hold a respective tool on the same axis at both ends in order to provide in each case one tool for engagement with a workpiece. In the example of embodiment, a cup wheel 32 and a combination cup grinding wheel 33 are attached to the tool spindle 30. A cup wheel 34 and a combination cup grinding wheel 35 are also attached to the tool spindle 31, but with different dimensions. If the machine 10 is configured as a polishing or fine-grinding machine, then instead of these it is possible to use suitably shaped polishing tools coated with e.g. PUR film as a polishing base or fine-grinding tools coated with diamond pellets.

Figure 4:
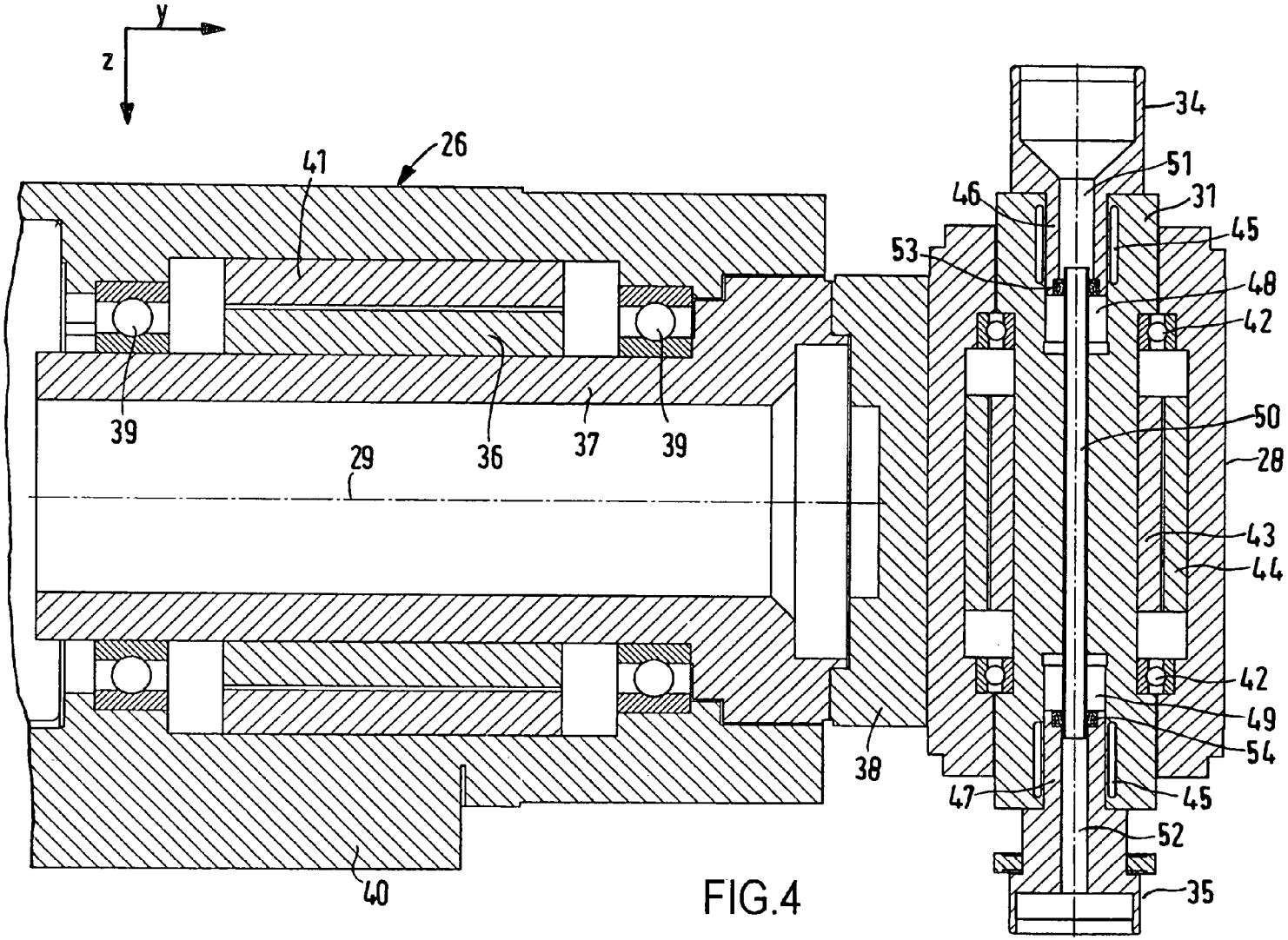
FIG. 4 shows a sectional view along the section line IV-IV in FIG. 3.

The drive motor 26 is a torque motor which is CNC-controlled with regard to its angle of rotation and is arranged on the same axis as the pivot axis 29, said torque motor being shown in longitudinal section in FIG. 4. The rotor 36 of the motor 26 is attached to a pivoting shaft 37 which is permanently connected to the spindle housing 28 via an intermediate flange 38 (for example by means of screws not shown here). The pivoting shaft 37 is mounted in a housing 40 via two spaced-apart roller bearings 39 such that it can be rotated but cannot be displaced in the axial direction. The stator 41 arranged concentrically to the rotor 36 of the motor 26 is fixed in the housing 40 so as not to rotate.

Of the two tools spindles 30 and 31 of identical design which are provided parallel to one another in the spindle housing 28, the tool spindle 31 is shown in longitudinal section in FIG. 4. The tool spindle 31 is mounted in the spindle housing 28 via two spaced-apart roller bearings 42 such that it can be rotated but cannot be displaced in the axial direction. The rotor 43 is located on the tool spindle 31, and the stator 44 of the torque motor which concentrically surrounds the rotor 43 is located in the housing 28. Hydraulic chucks 45 are provided at both ends of the tool spindle 31 in order to clamp the shafts 46 and 47 of the tools 34 and 35 inserted in cylindrical bores 48 and 49 of the tool spindle 31.

Figure 6:
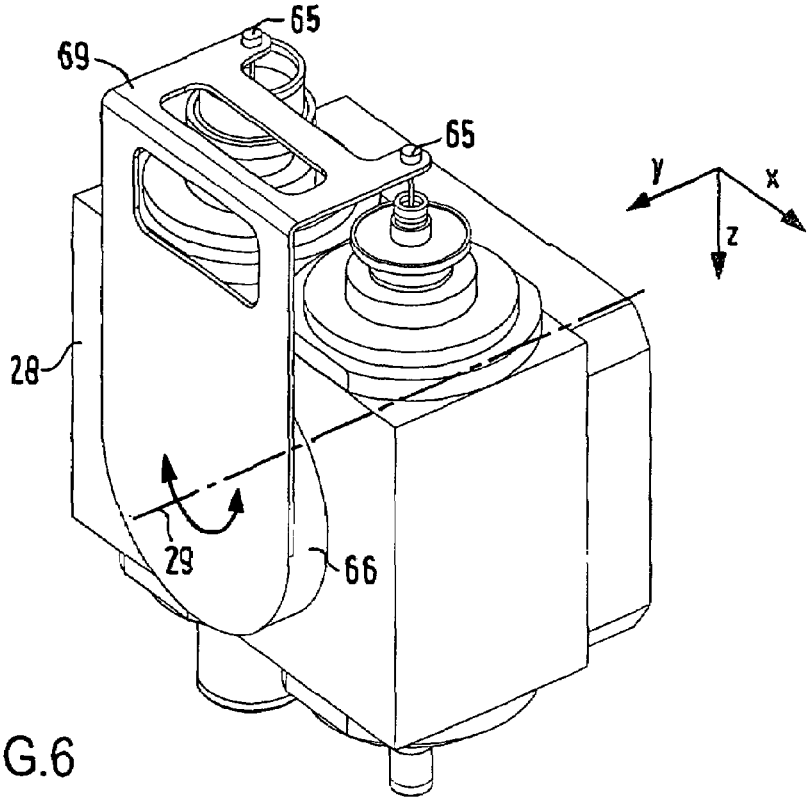
FIG. 6 shows a perspective view of a tool spindle housing with a nozzle holder for the positioning of coolant nozzles.

The tool spindle 31 is provided with a central tube 50 essentially over its entire length, which central tube is connected at both ends to internal recesses 51 and 52 of the tools 34 and 35 in a manner sealed by means of radial shaft sealing rings 53 and 54. This arrangement serves to supply coolant to the respectively active tool from the inside through the tool (FIG. 6).

Figure 2:
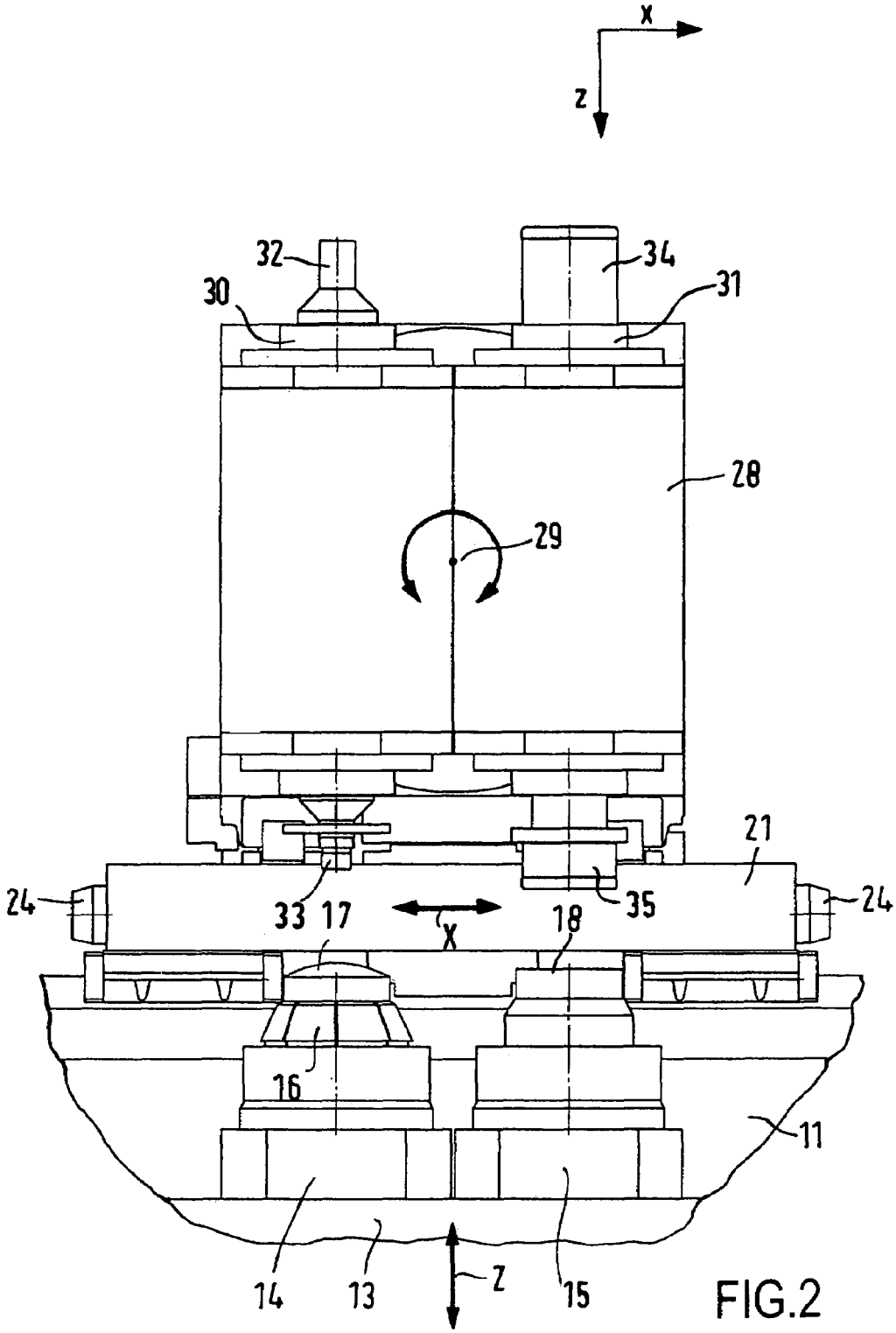
FIG. 2 shows the broken-away front view of the machine.

As can be seen from the drawings, e.g. from FIG. 2, the position of the pivot axis 29 with respect to the spindle housing 28 is selected in such a way that it runs approximately through the center of gravity of the spindle housing 28. In the illustrated arrangement of two tool spindles 30 and 31, the center of gravity is located approximately in the center between the two spindles 30, 31.

Figure 5:
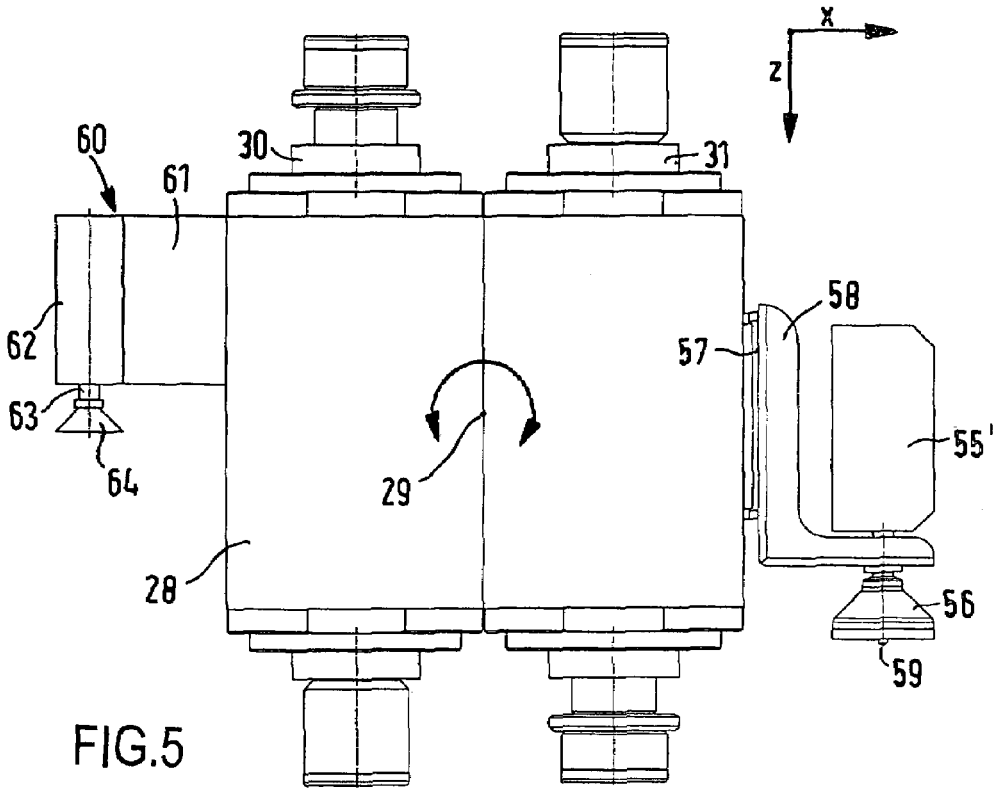
FIG. 5 shows the front view of a tool spindle housing with additionally attached functional elements.

At least one functional element for detecting the workpiece geometry or for handling the workpiece may be attached laterally to the outside of the spindle housing 28. As shown for example in FIGS. 12 and 13, the functional element may be a measurement sensor 55. In order to measure radii on workpieces, a ring spherometer 56 as the functional element may be attached laterally to the outside of the spindle housing 28 (FIG. 5). Spherometers according to DIN 58724 are suitable. As shown in FIG. 5, the spherometer 56 is mounted on the spindle housing 28 with the interposition of a flexible rubber layer, i.e. a plate 57, in order to achieve better adaptation of the measuring ring to the lens. The spherometer 56 is attached to the spindle housing 28 by means of an angular holder 58. As can also be seen from FIG. 5, a measurement system is attached to the holder 58 in conjunction with the ring spherometer 56, said measurement system being in the nature of an incremental measurement sensor 55' (e.g. the model MT 12 from the manufacturer Heidenhain), the sensing tip 59 of which protrudes from the measuring ring of the spherometer 56. The measurement system is protected against dirt and coolant by a suitable cover (not shown).

A functional element which serves for workpiece handling is also shown in FIG. 5. This comprises a loading arm 60, consisting of a spacer 61 and a pneumatic cylinder 62 with a piston rod 63, at the free end of which a suction cup 64 is attached. The mode of operation of this functional element is for example as follows: The suction cup 64 is moved over the workpiece in the workpiece spindle 14. The suction cup 64 is then moved downwards by means of the pneumatic cylinder 62 while the workpiece spindle 14 is moved upwards. The suction cup 64 can now exert suction on the lens 17, the collet chuck 16 is opened and the lens 17 is picked up by the suction cup 64. The suction cup 64 is then moved upwards in order firstly to buffer-store the lens 17 so that it can be picked up again by an external loading system (not shown). The latter has a suction cup which can be pivoted through 180°, which turns the lens 17 over and can place it upside down in one of the workpiece chucks.

As illustrated in FIG. 5, several different functional elements can be attached laterally to the spindle housing 28 at different points.

In order to supply a coolant to the tool respectively in active engagement, a nozzle holder 69 can be attached to the spindle housing 28 by means of a pneumatic or electric rotary drive 66 shown schematically in FIG. 6. Two nozzles 65 are attached to the nozzle holder 69 at a distance from the two workpiece spindles 30, 31, which nozzles produce a thin, only slightly diverging jet. Once the nozzle holder 69 has been precisely pivoted into the position shown in FIG. 6, the nozzle 65 located above the active tool spindle is supplied with coolant so that the coolant jet passes through the central tube 50 of the respective spindle into the center of the tool in active engagement. By means of the rotary drive 66, the nozzle holder 69 can selectively be held with respect to the spindle housing 28 in the relative position shown in FIG. 6 (or in a relative position rotated through 180° with respect to this position), so that the nozzle holder 69 moves with the spindle housing 28 or is rotated with respect to the spindle housing 28, for example through 90°, in order e.g. to allow a tool change.

Figure 7:
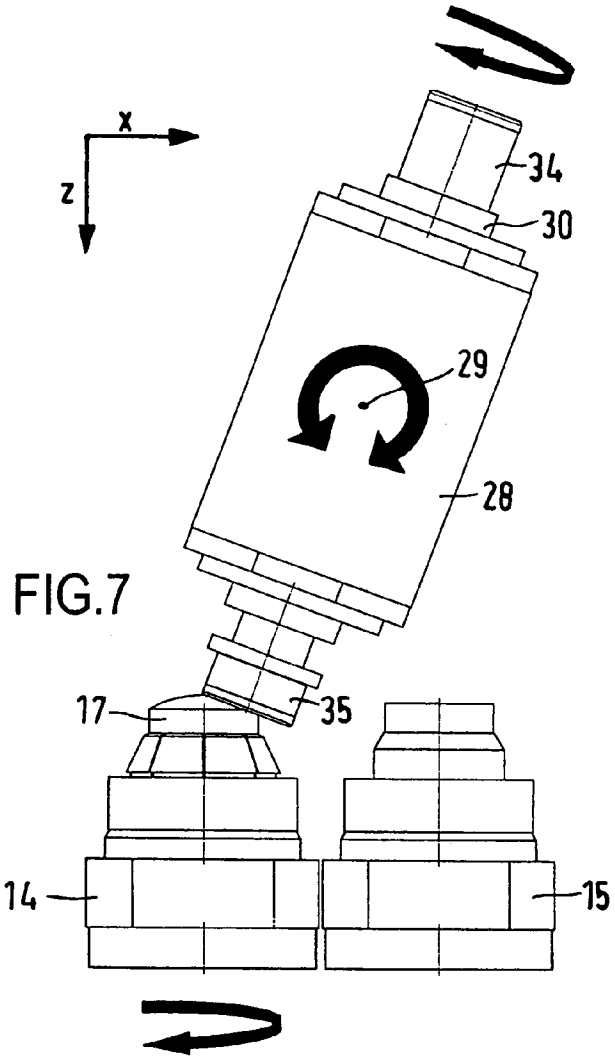
FIG. 7 shows the front view of a spindle housing, which is equipped with one tool spindle, and of two workpiece spindles, FIGS. 8 to 11, 14 and 15 in each case show the front view of a spindle housing, which is equipped with two tool spindles, and of two workpiece spindles, wherein different machining operations are shown, and FIGS. 12 and 13 in each case show the front view of a spindle housing, which is equipped with two tool spindles, and of two workpiece spindles, wherein a measurement sensor is shown in two different positions on the workpiece.

FIG. 7 shows the simplest embodiment of the invention with just one tool spindle 30, at the two ends of which a cup wheel 34 and a combination cup grinding wheel 35 are respectively attached by means of hydraulic chucks (45 in FIG. 4). The pivot axis 29 is arranged in the center of the spindle 30 at the center of gravity of the housing 28 at right angles to the axis of rotation of the spindle. One or (as shown in the drawing) two workpiece spindles 14 and 15 are arranged opposite the tool spindle 30. Since the rotating combination cup grinding wheel 35 is machining the lens 17 on the workpiece spindle 14, in this case only the spindle 14 is driven, as shown by the arrow symbol below the spindle 14.

Figure 8:
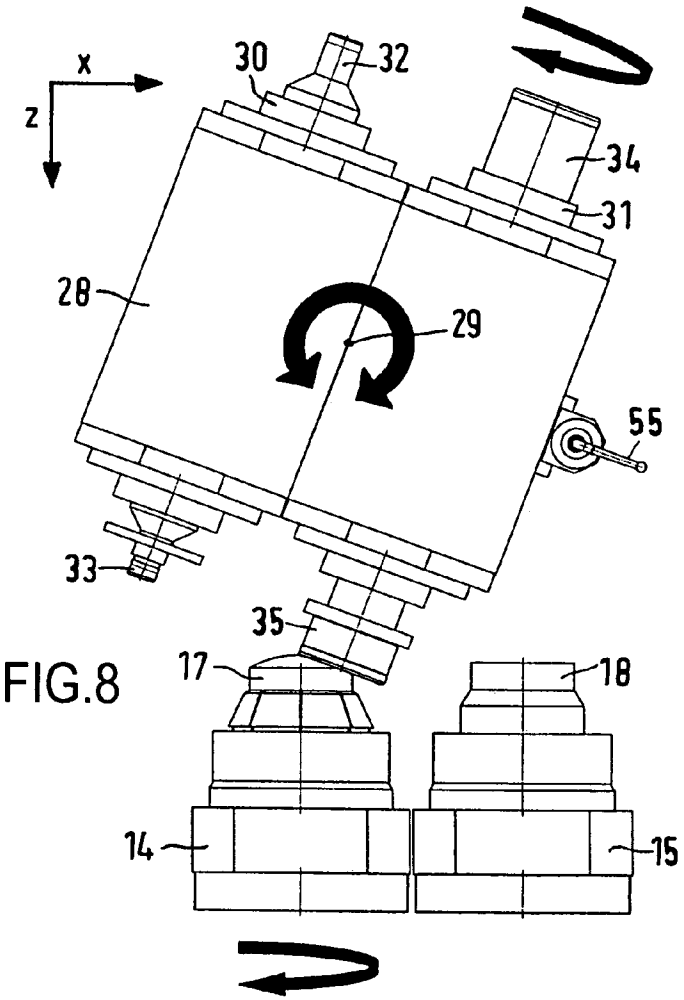

In FIG. 8, two tool spindles 30 and 31 are provided in a spindle housing 28, as has already been shown in FIGS. 1 to 6 and as has already been described with reference to these figures. The tool spindles 30 and 31 are equipped at both ends with cup tools 32, 34 and combination tools 33, 35, which in each case consist of a cup wheel and an edge grinding wheel. A measurement sensor 55 is attached to the side of the spindle housing 28. In the example shown, the lens 17 located on the workpiece spindle 14 is being machined, for which purpose the angle of rotation of the workpiece spindle 14 is CNC-controlled and the tool spindle 31 is driven at a controlled speed. Here, firstly the convex surface of the lens 17 is machined by means of the tool 35, wherein the combination cup grinding wheel 35 carries out an advance movement in the direction of the axis of the workpiece by rotating the two spindles 31 and 14 (flat grinding principle).

Figure 9:
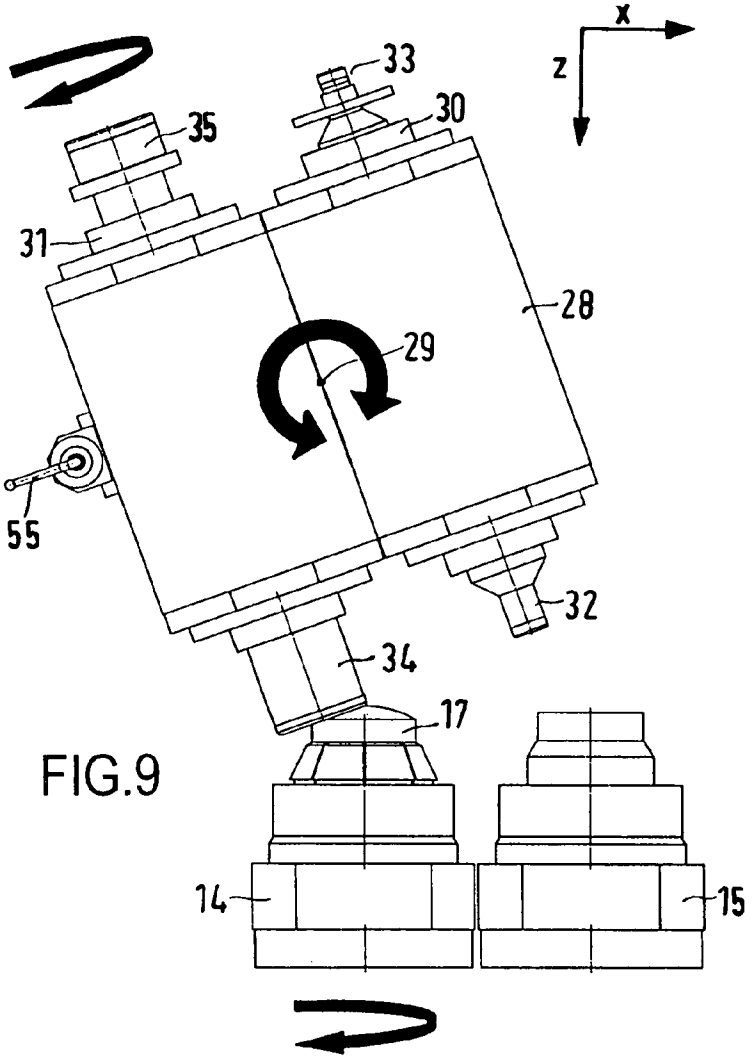

FIG. 9 shows the fine-grinding of the same lens surface of the lens 17. To this end, the spindle housing 28 with the two tool spindles 30 and 31 has been pivoted about the pivot axis 29 through approximately 180° by means of the drive motor 26 described with reference to FIG. 4, so that now the cup wheel 34 is in working engagement with the lens 17. For the rest, the mode of operation corresponds to that described above with reference to FIG. 8.

Figure 10:
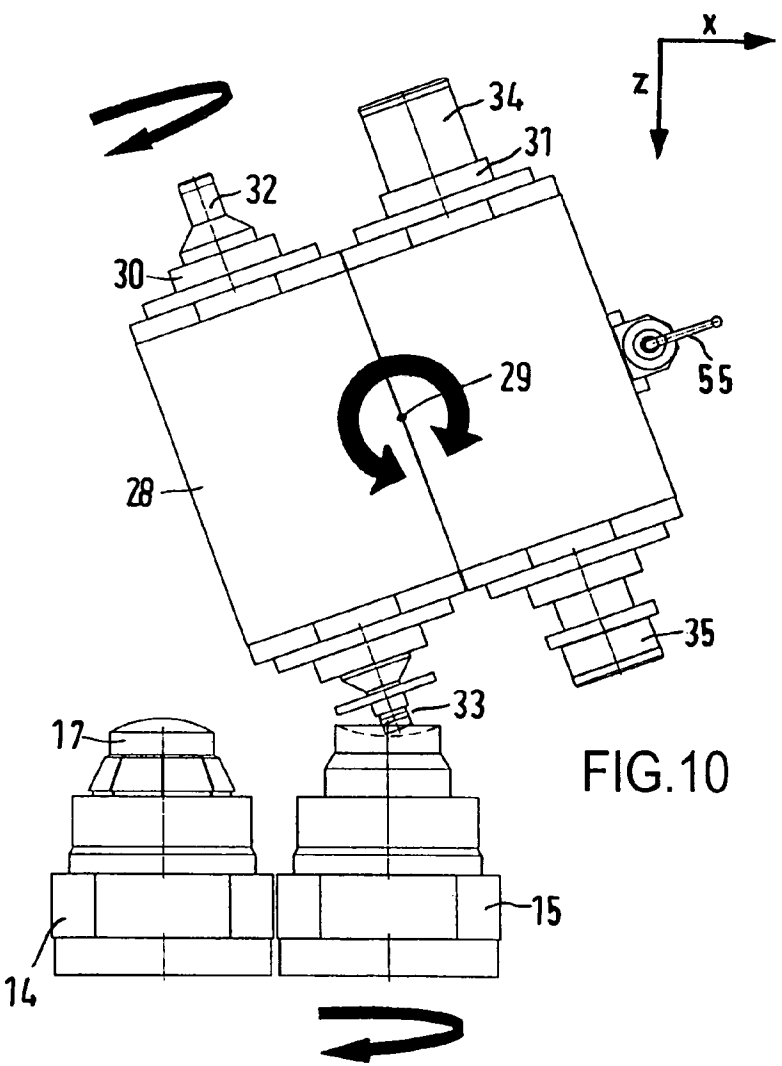

FIG. 10 shows the pre-grinding of a concave surface (shown in dashed line) by means of the combination cup grinding wheel 33 on the tool spindle 30. For this operating step, the tool spindle 30 and the workpiece spindle 15 are driven, as indicated by the respective arrow symbols.

Figure 11:
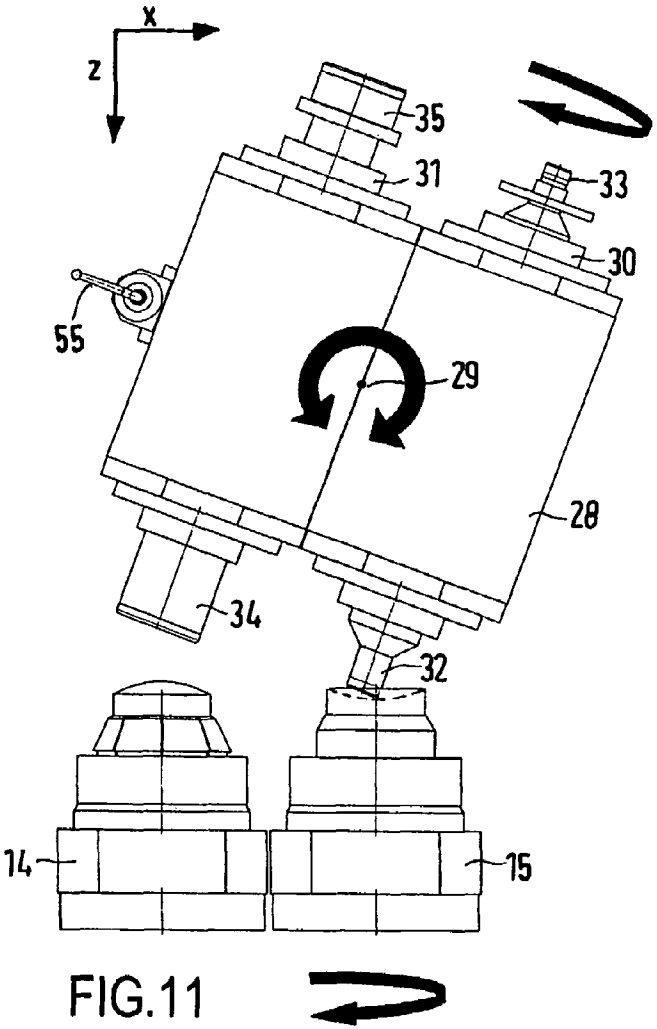

FIG. 11 shows the fine-grinding of the same concave surface, for which purpose the spindle housing 28 with the tool spindles 30 and 31 has been pivoted about the pivot axis 29 through approximately 180°. For this machining step, once again the tool spindle 30 and the workpiece spindle 15 are driven.

Figure 12:
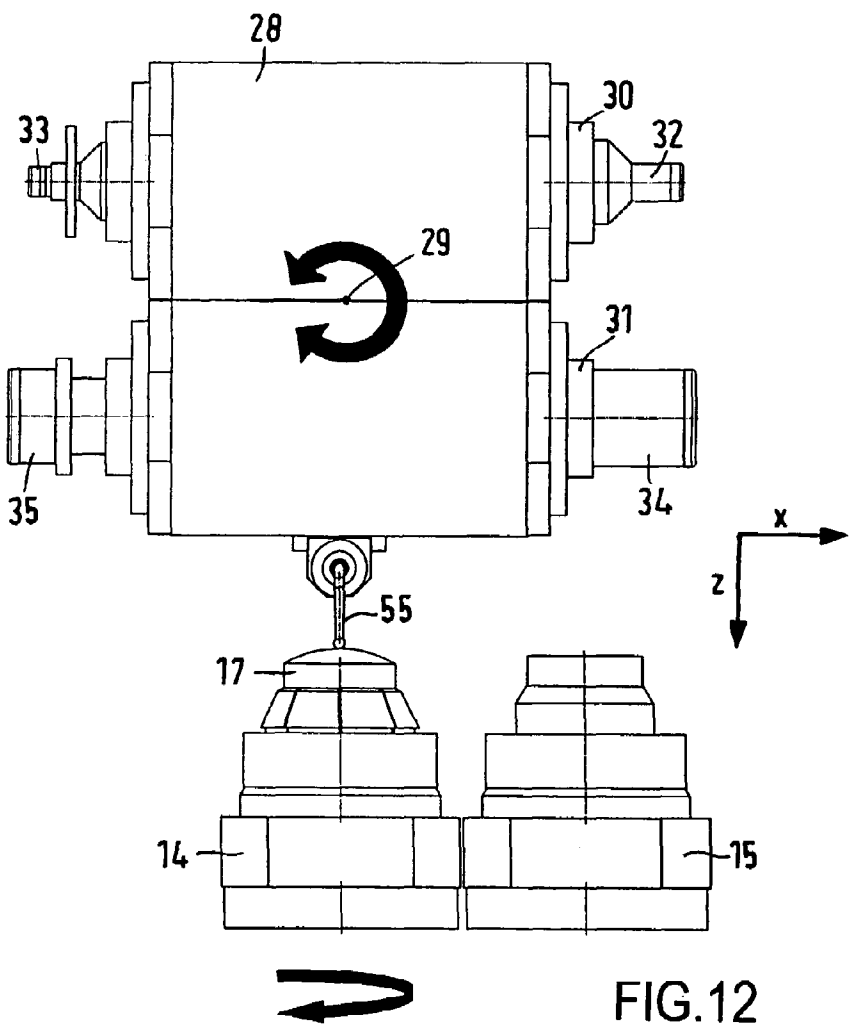

FIG. 12 illustrates the use of the measurement sensor 55 for measuring for example the central thickness of the lens 17. To this end, the spindle housing 28 must be pivoted so that the measurement sensor 55 is oriented coaxially with the axis of the workpiece spindle 14. The measurement sensor 55 can also be used to detect the overall geometry of the lens. This is particularly advantageous when measuring aspherical surfaces. The measured values can be read directly into the CNC control system in order to carry out automatic corrections and wear compensation.

Figure 13:
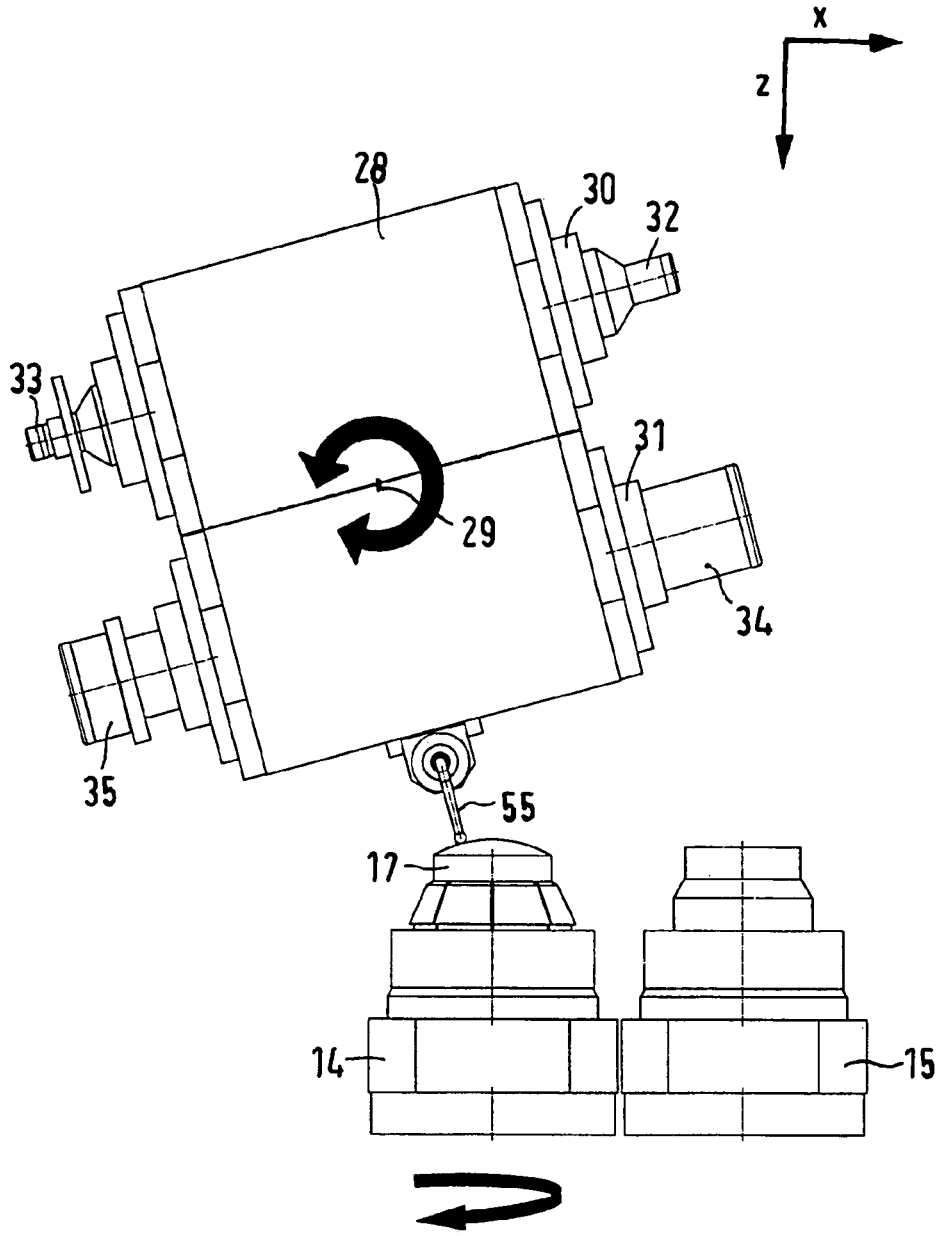

As shown in FIG. 13, the measurement sensor 55 can be pivoted with the spindle housing 28 with respect to the lens 17 about the pivot axis 29 in such a way that it senses in the normal direction, i.e. perpendicular to the tangent at the measuring point, with respect to the workpiece surface. In this way, it is also possible to measure workpiece surfaces with considerable inclinations, without this leading to incorrect measurements due to sensing tips being deflected away laterally. This possibility is particularly advantageous when using optical sensing systems such as laser autofocus, white light sensors or triangulation sensors, since these can often measure only to a limited extent on inclined surfaces.

Figure 14:
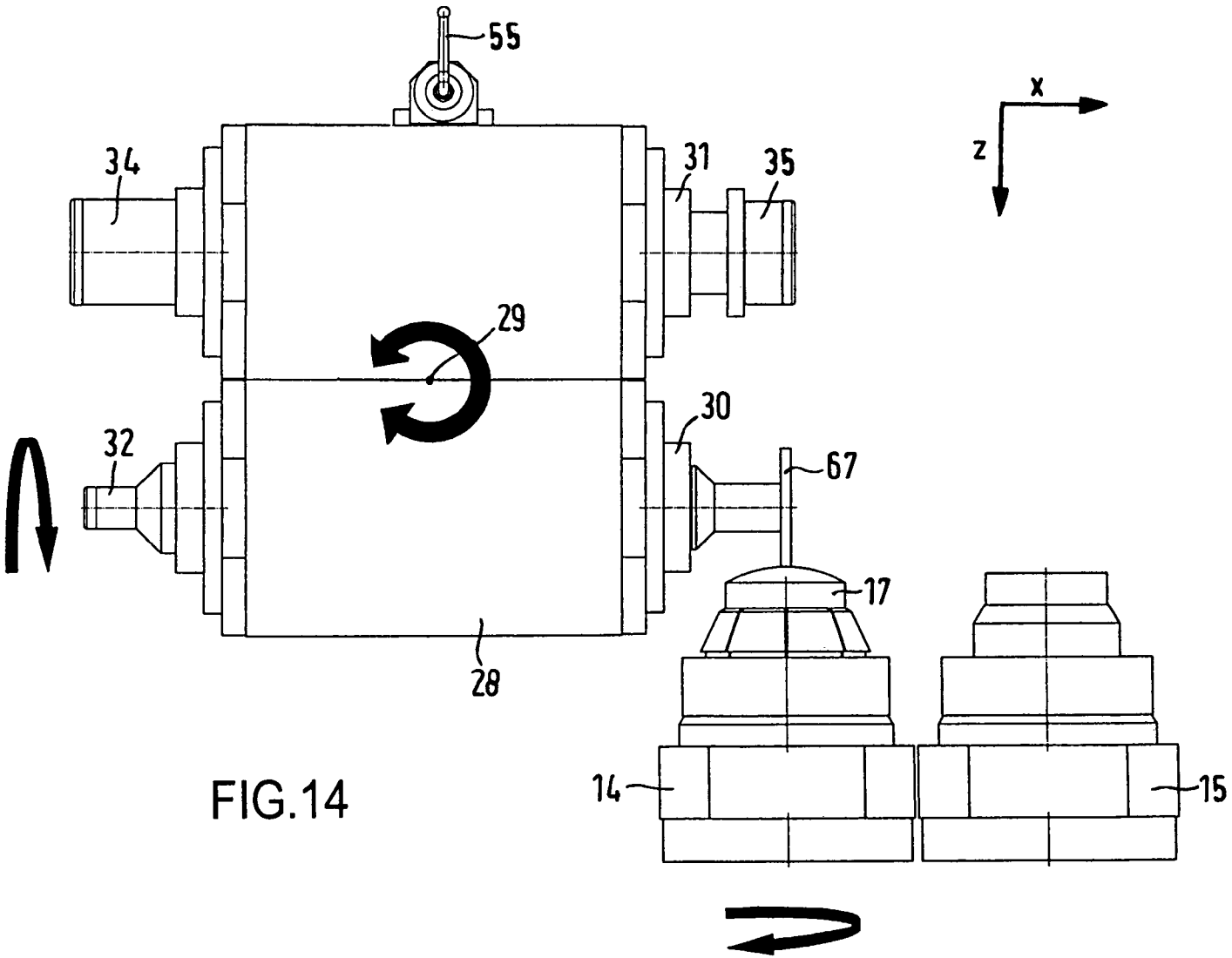

FIG. 14 shows the use of the spindle housing 28 with the tool spindles 30, 31 which can be pivoted about the pivot axis 29 for machining an aspherical or free-form surface on the lens 17 by means of an edge grinding wheel 67. This machining may take place according to the transverse rotary edge grinding principle or the longitudinal rotary edge grinding principle, wherein the workpiece surface can be machined either in a spiral or meandering manner.

Figure 15:
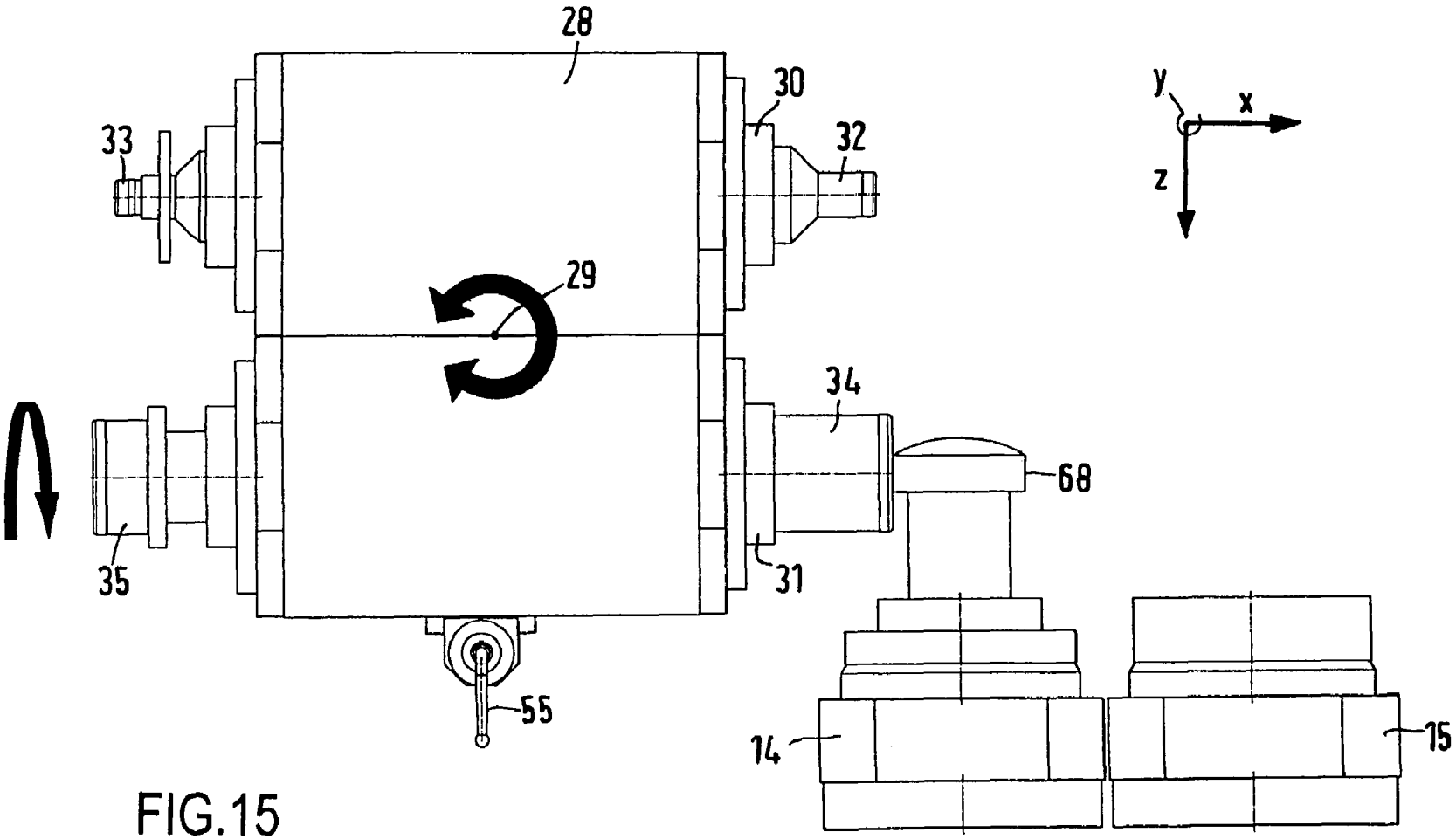

FIG. 15 shows the machining of a flat surface at the outer edge of a workpiece, wherein the end face of the cup wheel 34 is used. A linear advance in the direction of the Y-axis in this case produces a key-surface-type flattening at the outer edge 68 of the workpiece, wherein the workpiece spindle 14 remains stationary, i.e. it is not driven in rotation.

In summary, there is disclosed a grinding and polishing machine, in particular for lenses, which machine comprises at least one tool spindle and at least one workpiece spindle which can be adjusted relative to one another in directions perpendicular to one another. Here, the tool spindle is designed to hold a respective tool on the same axis at both ends and is mounted in a spindle housing which can be pivoted about a pivot axis arranged at right angles to the tool spindle in order to provide in each case one tool for machining engagement. Also provided is a device which can rotate the tool spindle into various defined angle positions with respect to the workpiece spindle. According to the invention, this device consists of just one drive arranged on the pivot axis, by means of which drive the tool spindle can be both pivoted about the pivot axis for the desired machining engagement and rotated about the pivot axis into said angle positions with respect to the workpiece spindle so that a compact and highly accurate machine is provided which makes it possible in a simple and cost-effective manner to use a plurality of grinding and polishing tools.

Other variations and modifications are possible without departing from the scope and spirit of the present invention as defined by the appended claims.

We claim:

1. A grinding and polishing machine for grinding or polishing optical workpieces to an optical quality, said machine comprising:

at least one tool spindle with two ends and at least one workpiece spindle which can be adjusted relative to one another in directions perpendicular to one another;

said tool spindle being constructed to hold a respective tool on the same axis at both ends of the tool spindle and being mounted in a spindle housing which can be pivoted about a pivot axis that runs through the center of gravity of the spindle housing and is arranged at right angles to the tool spindle in order to provide in each case one of the two tools for engagement with the workpiece and which can rotate the tool spindle into various defined angle positions with respect to the workpiece spindle;

a drive system which, via the spindle housing, can drive the tool spindle about the pivot axis for the desired tool engagement with the workpiece and rotate the tool spindle about the pivot axis into various defined angle positions with respect to the workpiece spindle; and the drive system being a torque motor that is arranged on the same axis as the pivot axis and is CNC-controlled with regard to the angle of rotation about the pivot axis, the torque motor having a rotor which is permanently connected to the spindle housing via a pivoting shaft so as to directly drive the tool spindle without a gearing system.

2. A grinding and polishing machine according to claim 1, wherein a plurality of said tool spindles are provided parallel to one another in the spindle housing.

3. A grinding and polishing machine for grinding or polishing optical workpieces to an optical quality, said machine comprising:

at least one tool spindle with two ends and at least one workpiece spindle which can be adjusted relative to one another in directions perpendicular to one another;

said tool spindle being constructed to hold a respective tool on the same axis at both ends of the tool spindle and being mounted in a spindle housing which can be pivoted about a pivot axis arranged at right angles to the tool spindle in order to provide in each case one of the two tools for engagement with the workpiece;

a drive system which can drive the tool spindle about the pivot axis for the desired tool engagement with the workpiece and rotate the tool spindle about the pivot axis into various defined angle positions with respect to the workpiece spindle; and wherein at least one functional element for detecting geometry of the workpiece or for handling the workpiece is attached laterally to the outside of the spindle housing.

4. A grinding and polishing machine according to claim 3, wherein said functional element is a measurement sensor.

5. A grinding and polishing machine according to claim 3, wherein said functional element is a ring spherometer with the interposition of a flexible rubber layer for measuring radii on workpieces.

6. A grinding and polishing machine according to claim 3, wherein a loading arm with a suction cup is attached to the spindle housing for workpiece handling purposes.

7. A grinding and polishing machine according to claim 3, wherein a loading arm with a gripper is attached to the spindle housing for workpiece handling purposes.

8. A grinding and polishing machine according to claim 3, wherein several different functional elements are attached laterally to the outside of the spindle housing at different points.

9. A grinding and polishing machine for grinding or polishing optical workpieces to an optical quality, said machine comprising:

at least one tool spindle with two ends and at least one workpiece spindle which can be adjusted relative to one another in directions perpendicular to one another;

said tool spindle being constructed to hold a respective tool on the same axis at both ends of the tool spindle and being mounted in a spindle housing which can be pivoted about a pivot axis arranged at right angles to the tool spindle in order to provide in each case one of the two tools for engagement with the workpiece;

a drive system which can drive the tool spindle about the pivot axis for the desired tool engagement with the workpiece and rotate the tool spindle about the pivot axis into various defined angle positions with respect to the workpiece spindle; and wherein the tool spindle is provided with a central tube essentially over its entire length, which central tube is connected through the tool at both ends to internal recesses of the tools for the purpose of supplying coolant, wherein a coolant nozzle is positioned on the side of the tool spindle remote from the active tool.

10. A grinding and polishing machine according to claim 9, wherein a nozzle holder is attached to the spindle housing by means of a pneumatic rotary drive.

11. A grinding and polishing machine according to claim 9, wherein a nozzle holder is attached to the spindle housing by means of an electric rotary drive.

* * * * *